US008157087B2

(12) United States Patent
Tanbo et al.

(10) Patent No.: US 8,157,087 B2
(45) Date of Patent: Apr. 17, 2012

(54) PACKAGE OF ROD-SHAPED SMOKING ARTICLES AND A BLANK THEREFOR

(75) Inventors: Hitoshi Tanbo, Tokyo (JP); Toru Iwano, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 12/609,679

(22) Filed: Oct. 30, 2009

(65) Prior Publication Data

US 2010/0044256 A1 Feb. 25, 2010

Related U.S. Application Data

(63) Continuation of application No. PCT/JP2008/057698, filed on Nov. 13, 2008.

(30) Foreign Application Priority Data

May 1, 2007 (JP) ..... 2007-120675

(51) Int. Cl.
*B65D 85/10* (2006.01)

(52) U.S. Cl. ..... 206/268; 206/273; 229/182.1

(58) Field of Classification Search ..... 206/259, 206/268, 242, 265, 271, 273, 275, 272, 258; 229/160.1, 189, 198, 182.1, 198.1, 182, 186, 229/198.2, 198.3

See application file for complete search history.

(56) References Cited

U.S. PATENT DOCUMENTS

| | | | | | |
|---|---|---|---|---|---|
| 1,299,683 | A * | 4/1919 | Crowell | 229/125.37 |
| 2,932,439 | A * | 4/1960 | Sparling | 229/182 |
| 5,143,282 | A * | 9/1992 | Pham | 229/160.1 |
| 5,799,797 | A * | 9/1998 | Braun | 206/586 |
| 5,833,060 | A * | 11/1998 | Draghetti et al. | 206/268 |
| 6,457,580 | B1 * | 10/2002 | Focke et al. | 206/259 |
| 2004/0055909 | A1 * | 3/2004 | Gamberi et al. | 206/271 |
| 2005/0224375 | A1 * | 10/2005 | Focke et al. | 206/259 |

FOREIGN PATENT DOCUMENTS

| | | | |
|---|---|---|---|
| CA | 2437938 | C | 7/2007 |
| JP | 4-279446 | A | 10/1992 |
| JP | 2004-59001 | A | 2/2004 |
| JP | 2004-524228 | A | 8/2004 |
| JP | 2005-523854 | A | 8/2005 |
| RU | 2 062 739 | C1 | 6/1996 |
| UA | 64837 | C2 | 3/2004 |
| UA | 74626 | C2 | 1/2006 |
| UA | 74627 | C2 | 1/2006 |

* cited by examiner

*Primary Examiner* — Steven A. Reynolds
(74) *Attorney, Agent, or Firm* — Birch, Stewart, Kolasch & Birch, LLP

(57) ABSTRACT

A hinge-lid package has a box body and a lid, the box body and the lid being formed from a blank (28). The blank (28) has strip-like notch arrays (16*a* and 18*a*) for making longitudinal edges of the box body and of the lid into round edges. The notch arrays (16*a* and 18*a*) have a large number of notch rows (19) formed only in the inner surface of the blank (28). The notch rows (19) are inclined in relation to the longitudinal direction of the blank (28), and are formed at intervals in a width direction of the notch arrays (16*a* and 18*a*).

5 Claims, 8 Drawing Sheets

PACKAGE OF ROD-SHAPED SMOKING ARTICLES AND A BLANK THEREFOR

This application is a Continuation of copending PCT International Application No. PCT/JP2008/057698 filed on Nov. 13, 2008 which designated the United States, and for which priority is claimed under 35 U.S.C. §120; and this application claims priority of Application No. 2007-120675 filed in Japan on May 1, 2007 under 35 U.S.C. §119; the entire contents of all are hereby incorporated by reference.

TECHNICAL FIELD

The present invention relates to a package of rod-shaped smoking articles, such as cigarettes and filter cigarettes, and a blank for the package.

BACKGROUND ART

A package of this type is generally called a hinge-lid package. The hinge-lid package has a rectangular parallelepiped shape and includes four angular edges extending along its longitudinal direction. Because of the angular edges, the package does not fit well in the hand when the user grasps the package.

To solve this problem, one well-known package has round edges that are rounded, instead of the angular edges (for example, Patent Document 1 mentioned below). Since the package disclosed in Patent Document 1 has the round edges, the package fits comfortably in the hand when the user grasps the package.

In order to produce the round edges, a blank for the package disclosed in Patent Document 1 has notch (nick) line arrays in its inner face. Each of the notch arrays is made up of a plurality of notch lines. The notch lines extend parallel to each other along the longitudinal direction of the blank.

The notch line arrays that offer the round edges are not exposed in the outer surface of the package, so that they do not disfigure the package.

Patent Document 1: Published Patent Application JP No. 2004-524228

DISCLOSURE OF THE INVENTION

Problems to be Solved by the Invention

Since the blank is uneven in thickness, one notch line included in the notch line arrays might be located in a thin region of the blank. In such a case, the blank has extremely thin regions between the bottoms of one notch and its outer surface, and local fragile portion is formed in the notch line array.

When the blank is folded, therefore, stress is concentrated at the fragile portion of the notch line array. Because of such stress concentration, the notch line array is folded at acute angles in their fragile portion, and the round edge cannot be neatly formed.

It is an object of the invention to provide a package of rod-shaped smoking articles having at least one neat round edge and a blank for the package.

Means for Solving the Problem

In order to accomplish the object, the package of the invention comprises a box body with an open end, and a box-shaped lid connected to the open end of the box body through a hinge, for opening/closing the open end. The box body includes a round edge forming at least one of longitudinal edges extending along a longitudinal direction of the box body, and having an arc-like shape as seen in cross-section of the box body. The round edge has a notch array, which provides the arc-like shape of the round edge, only in an inner surface thereof. Each of the notch arrays is formed of a plurality of notch lines. The notch lines are inclined in relation to the longitudinal direction of the box body and arranged at intervals in a width direction of the round edge.

Since the notch arrays are formed only in the inner surface of the round edges, the notch lines of the notch arrays are not exposed in the outer surface of the round edges. It is then possible to provide smooth round edges.

To be more precise, the notch line is formed of a notch row. The notch row includes a plurality of notches arranged at intervals in the row direction of the notch row.

Preferably, the round edge is formed in each of four longitudinal edges of the box body. In this case, the two round edges defining the width of the box body are arranged symmetrically to a longitudinal axis of the box body.

A lid may also have four round edges corresponding to the round edges of the box body.

Preferably, the box body further includes a reinforcing patch disposed in the inner surface of each of the round edges. The reinforcing patches are disposed near the open end of the box body. To be concrete, the reinforcing patches can be made of glue.

The invention also provides a blank for the package. The blank includes notch arrays for forming round edges. The blank will be precisely described below in the Best Mode of Carrying out the Invention.

When the package is fabricated from the blank, each of the notch lines of the notch array extends in a longitudinal direction of the package. For that reason, even if there is the above-mentioned thin region of the blank, where the round edge is formed, and if the thin region extends in the longitudinal direction of the package, the notch lines of the notch arrays merely pass across the thin region. Consequently, there is a low possibility that the notch lines produce the fragile portions in the blank, so that the folding assembly of the blank can be stably embodied.

Technical Advantage of the Invention

The package of rod-shaped smoking articles and the blank for the package have the round edge whose arc-like shape is obtained by the notch arrays formed only in the inner surface of the round edge (inner surface of the blank). The notch array is therefore not exposed in the outer surface of the package. The package therefore has a beautiful appearance.

Since each of the notch lines of the notch array is inclined in relation to the longitudinal direction (longitudinal folding line) of the box body, even if the blank is uneven in thickness, the folding process of the blank, that is, the fabrication of the package, can be stably carried out.

The size of the round edge is determined by the width of the corresponding notch array and the inclined angles of the notch lines. This makes it easy to create the round edges of arbitrary sizes.

With or without the notch arrays, the reinforcing patches prevent a deformation in the open end of the box body, so that the lid can be smoothly and reliably opened/closed.

BEST MODE FOR CARRYING OUT THE INVENTION

Figure 1:
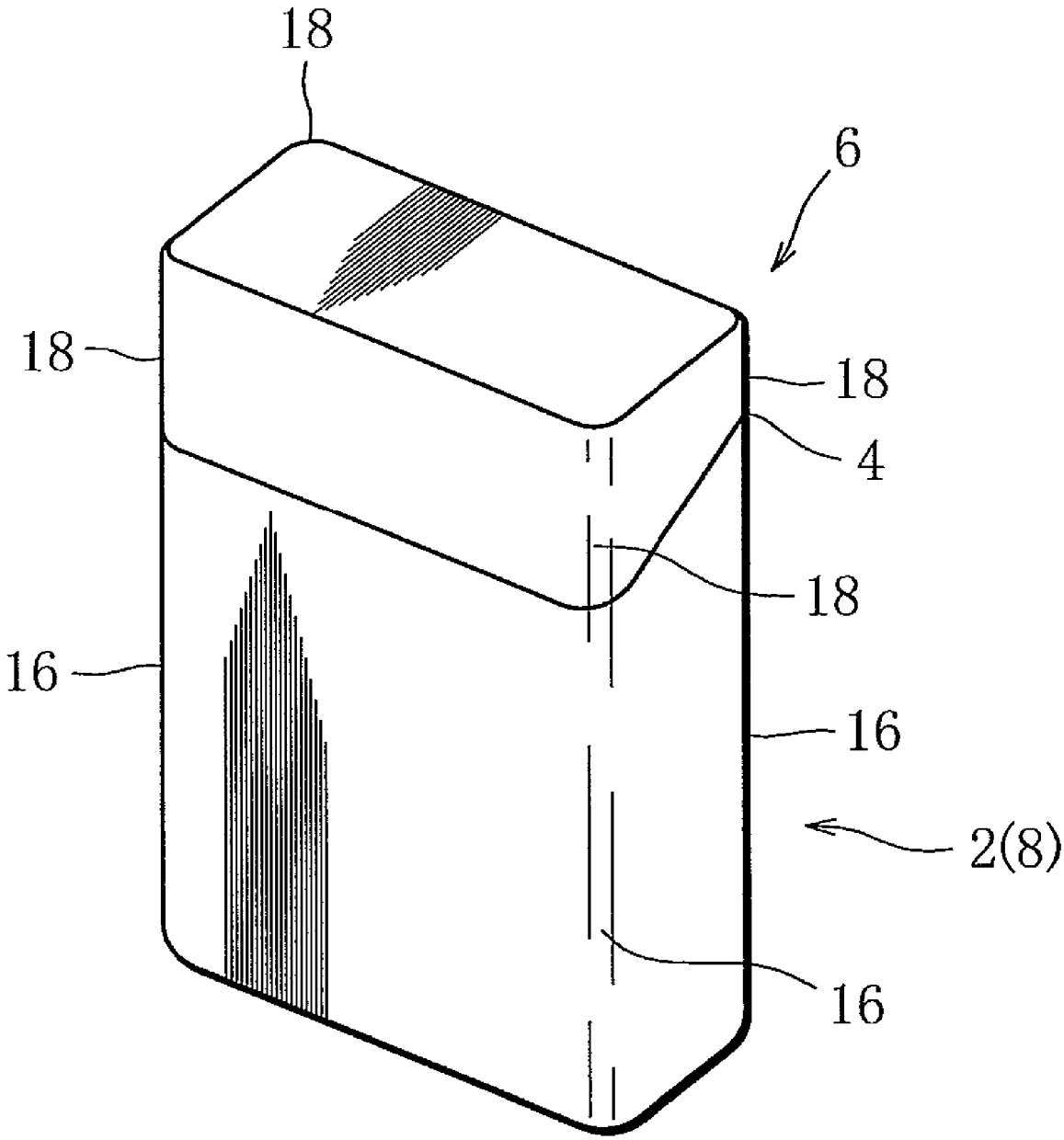
FIG. 1 is a perspective view showing a package of one embodiment in a closed position thereof.

FIG. 1 shows a hinge-lid package of one embodiment.

The package shown in FIG. 1 has a substantially rectangular parallelepiped shape as a whole, and is covered with a transparent overwrapping film (not shown). The overwrapping film has a tear tape. When the overwrapping film is opened along the tear tape, the package is partially exposed. The overwrapping film is omitted from FIG. 1.

The package includes a box 2. The box 2 has an upper end that is open. This open end is closed with a lid 6. The lid 6 is connected to a rear edge of the open end of the box 2 through a self hinge 4. The lid 6 is capable of turning around the self hinge 4, to thereby open/close the open end of the box 2.

Figure 2:
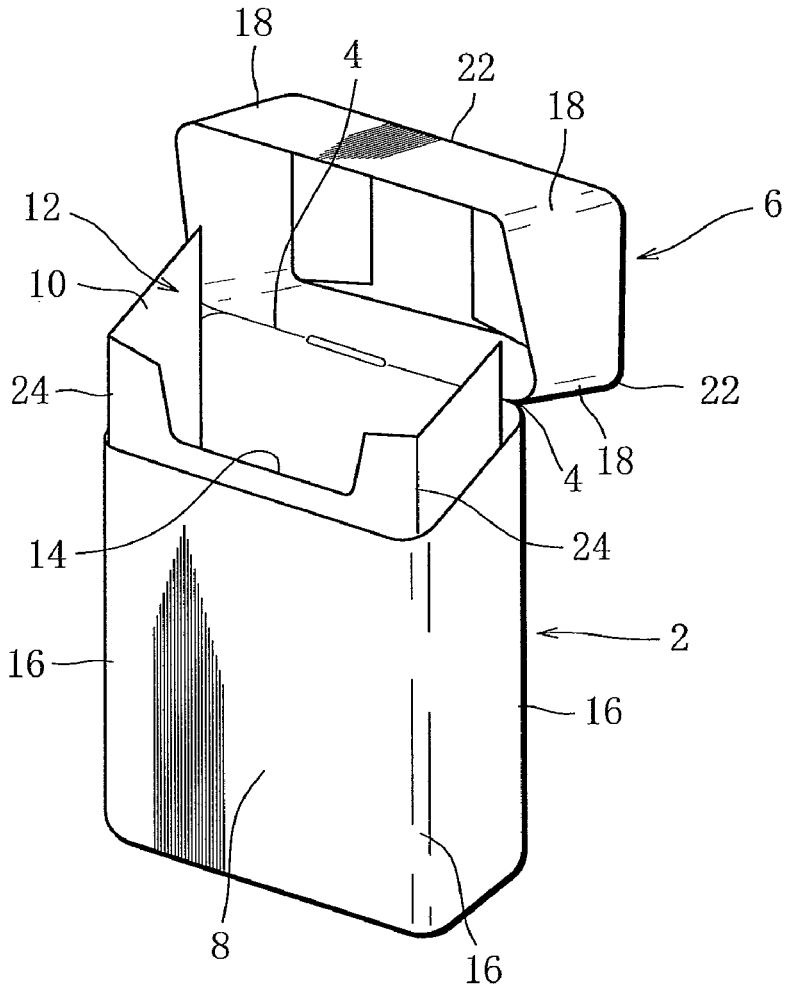
FIG. 2 is a perspective view showing the package shown in FIG. 1 in an open position thereof.

More concretely, as is apparent from FIG. 2, the box 2 includes a box body 8, and the box body 8 has an upper end that is cut open at an angle. The box 2 further includes an inner frame 10 having a shape of letter U. The inner frame 10 is partially projecting from the upper end of the box body 8 and forms an open end 12 of the box 2. The inner frame 10 has an access opening 14 in a front wall thereof. The access opening 14 has a substantially U-like shape.

The lid 6 has a box-like shape and has a lower end that is cut open at an angle. The lid 6 closes the open end 12 of the box 2 in a position covering the projecting portion of the inner frame 10. At this point of time, the lower end of the lid 6 meets onto the upper end of the box body 8.

The box body 8 of an ordinary type has four angular edges extending in the longitudinal direction thereof. According to the embodiment, however, the box body 8 has round edges 16 instead of angular edges. The round edges 16 each have an arc-like shape as seen in cross-section of the box body 8. The lid 6 also has similar round edges 18 corresponding to the round edges 16. When the lid 6 is closed, each of the round edges 16 and the corresponding round edge 18 are aligned with each other as is obvious from FIG. 1, thereby forming one longitudinal edge of the package.

The inner frame 10 generally includes two angular edges 24.

Figure 3:
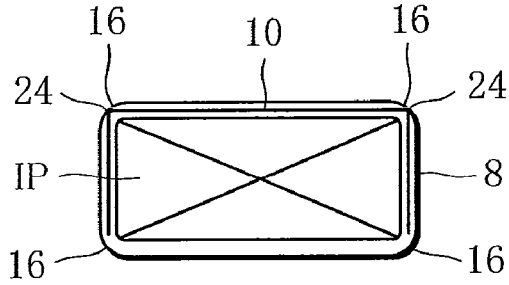
FIG. 3 is a schematic cross-sectional view showing a box body shown in FIGS. 1 and 2.

As is clear from FIG. 3, an inner pack IP is contained in the box body 2. The inner pack IP is surrounded by the inner frame 10. The inner pack IP includes a bundle of twenty filter cigarettes as rod-like smoking articles, and an inner wrapper in which the bundle is wrapped.

Figure 4:
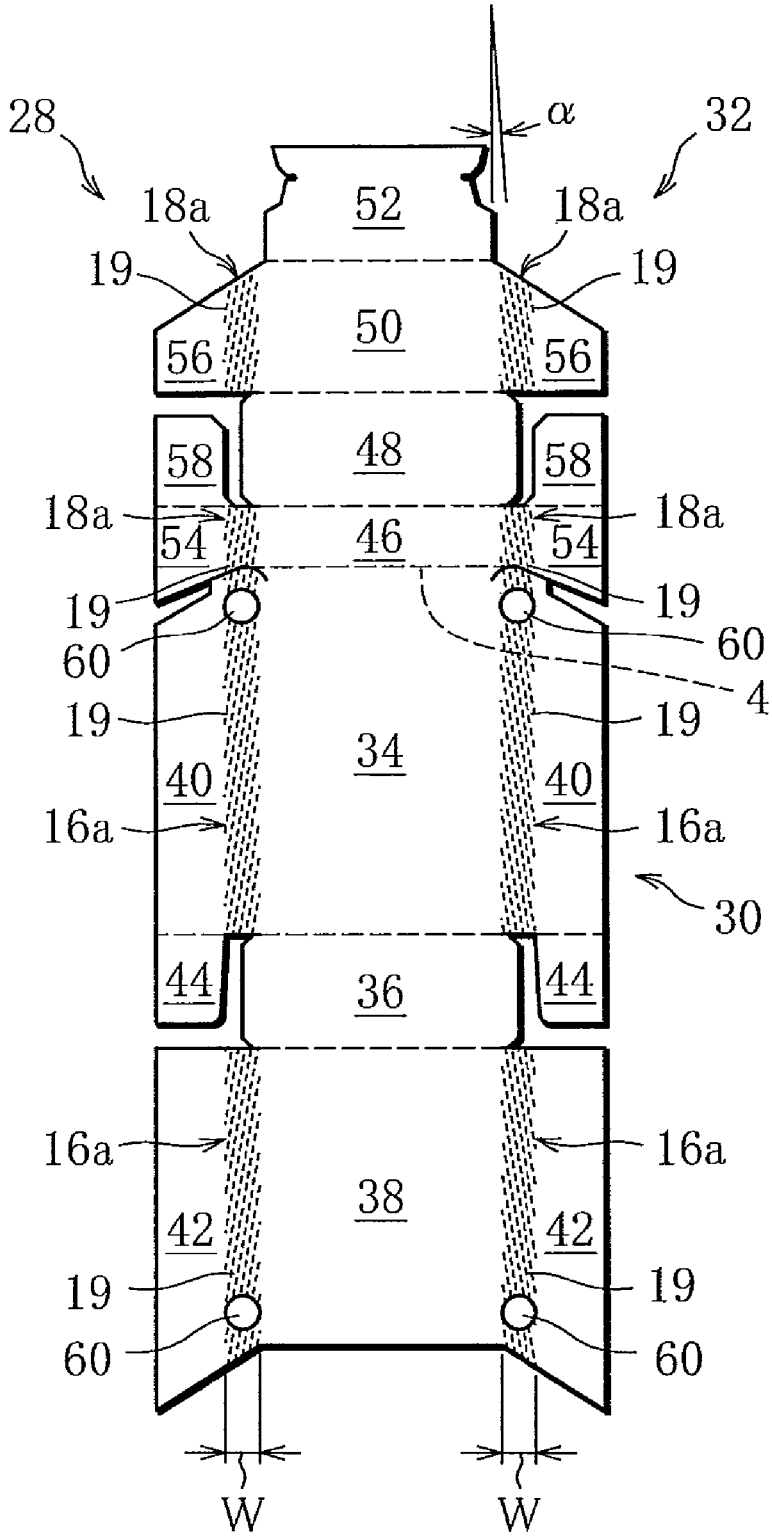
FIG. 4 is a view showing an inner surface of a blank for forming the box body and a lid shown in FIGS. 1 and 2.
Figure 5:
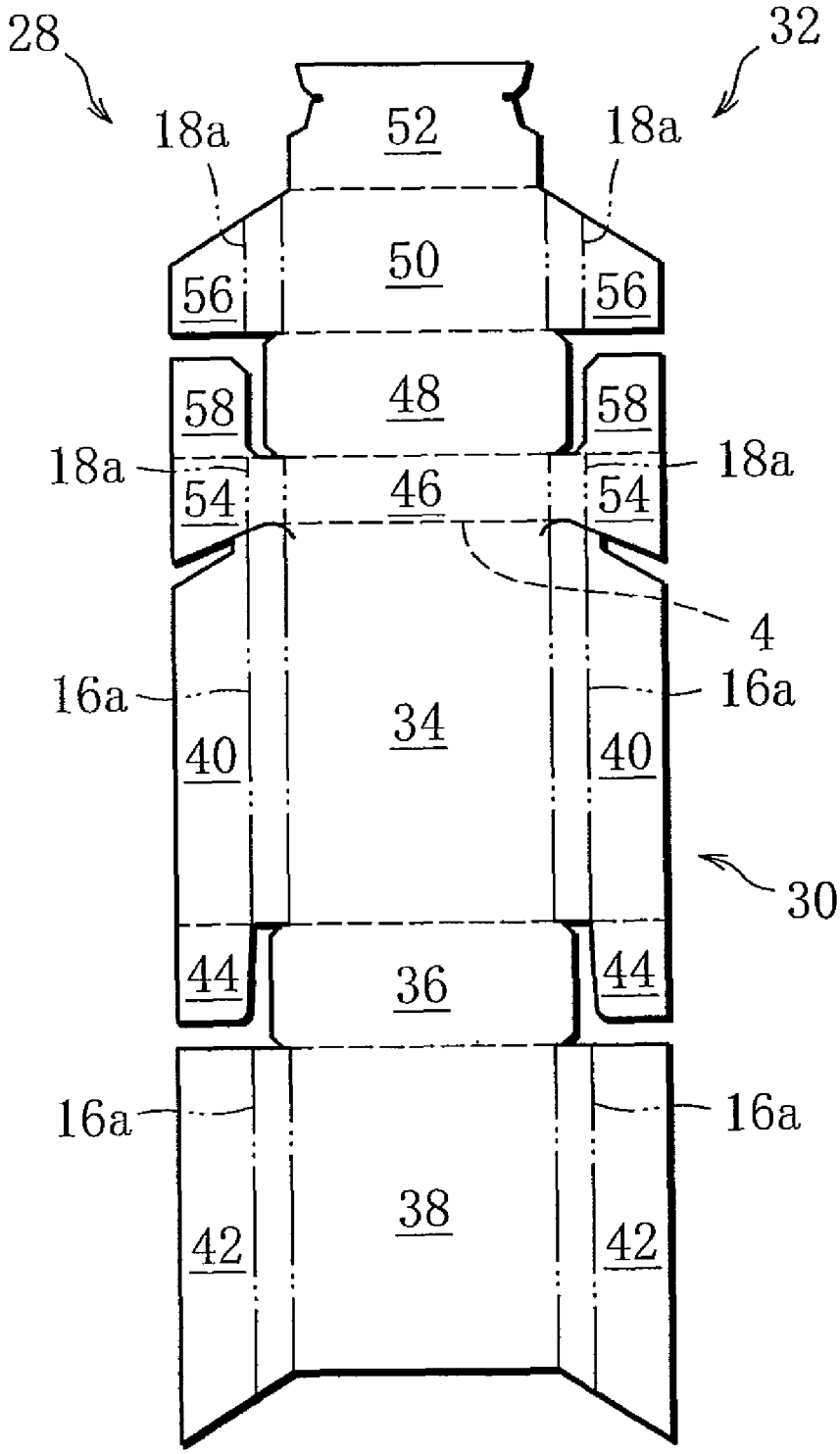
FIG. 5 is a view showing an outer surface of the blank shown in FIG. 4.

Features of the package of the invention will be clarified in the following descriptions about a blank 28 for forming the box body 8 and the lid 6. FIGS. 4 and 5 show inner and outer surfaces, respectively, of the blank 28.

As a basic form and folding process of the blank 28 are publicly known, the basic form of the blank 28 will be briefly described below.

The blank 28 is roughly divided into a main section 30 for forming the box body 8 and a subsection 32 for forming the lid 6. The main section 30 extends in one direction. The subsection 32 is connected to an upper end of the main section 30 through the self hinge 4 as seen in FIG. 4.

The main section 30 includes a rear panel 34, a bottom panel 36, and a front panel 38, in the order named from the subsection 32-side, or the self hinge 4-side. These panels 34, 36 and 38 are disposed in the longitudinal direction of the main section 30. Each two adjacent panels are connected to each other through a horizontal fold line extending across the main section 30. The panels 34, 36 and 38 form rear, bottom and front walls, respectively, of the box body 8.

Inner side flaps 40 are connected to both sides of the rear panel 34 through longitudinal fold lines extending in the longitudinal direction of the main section 30. The inner side flaps 40 form inner parts of side walls of the box body 8. Outer side flaps 42 are connected to both sides of the front panel 38 through longitudinal fold lines. The outer side flaps 42 form outer parts of the side walls. In short, the side walls of the box body 8 are formed by superposing the inner side flaps 40 upon the respective outer side flaps 42.

With reference to FIG. 4, inner bottom flaps 44 are connected to lower ends of the inner side flaps 40 through horizontal fold lines. The inner bottom flaps 44 are reinforcing members for the bottom panel 36, and form inner parts of the bottom wall of the box body 8.

The subsection 32 includes a rear panel 46, a top panel 48, a front panel 50 and an inner front panel 52. The panels 46, 48, 50 and 52 are disposed in the order named from the rear panel 34-side. Each two adjacent panels are connected to each other through a horizontal fold line. The panels 46, 48 and 50 form rear, upper and front walls, respectively, of the lid 6. The inner front panel 52 is a reinforcing member for the front panel 50, and forms an inner part of the front wall of the lid 6.

As is apparent from FIG. 4, the bottom panel 36 and the top panel 48 forming the bottom wall of the box body 8 and the upper wall of the lid 6, respectively, have four arc-shaped corners corresponding to the round edges 16 and 18.

Inner side flaps 54 are connected to both sides of the rear panel 46 through longitudinal fold lines. Outer side flaps 56 are connected to both sides of the front panel 50 through longitudinal fold lines. Each of the inner flaps 54 and the corresponding outer side flap 56, which are disposed on either same side as seen from the subsection 32, are superposed upon each other to form one of side walls of the lid 6.

Inner top flaps 58 are connected to upper edges of the inner side flaps 54 through horizontal fold lines. The inner top flaps 58 are reinforcing members for the top panel 48, and form inner parts of the upper wall of the lid 6.

In general, each of the horizontal fold lines is a linear indent that is formed in the blank 28. However, the longitudinal fold lines forming the round edges 16 and 18 are not indents. The longitudinal fold lines have a shape of a strip extending in the longitudinal direction of the blank 28, and are formed into a notch array with a given width W.

To put it concretely, the longitudinal fold lines are made up of notch arrays 16*a* and 18*a*. The notch arrays 16*a* and 18*a* are disposed in an inner surface of the blank 28. The notch arrays 16*a* and 18*a* include a large number of notch rows 19. The notch rows 19 extend parallel to each other where the notch rows 19 are inclined at a given inclined angle $\alpha$ in relation to the longitudinal direction of the blank 28. The notch rows 19 are arranged at regular intervals in a width direction of the corresponding notch array. The number of the notch rows 19 within the width of the notch array is, for example, about five. The inclined angle $\alpha$ is chosen from a range from 5 to 30 degrees, or preferably, falls in a range from 10 to 15 degrees.

Figure 6:
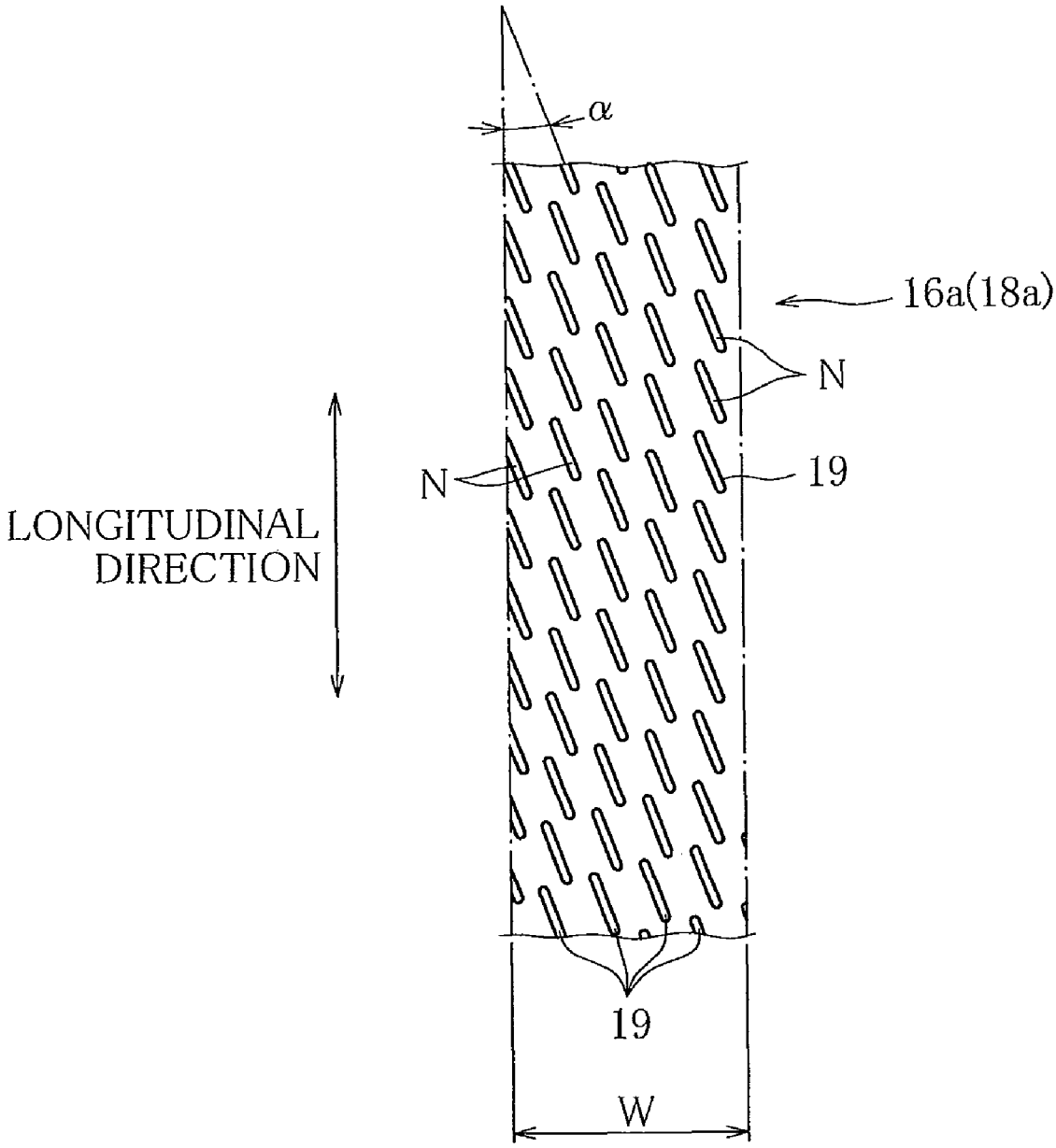
FIG. 6 is a view showing, in an enlarged scale, a part of a notch array formed in the blank shown in FIG. 4.

As shown in FIG. 6 in an enlarged scale, each of the notch rows 19 is formed of a plurality of notches N. To be specific, the notches N are groove-like recesses, or pits, formed in an inner surface of the blank 28. The notches N are arranged at given intervals in a row direction of the corresponding notch row 19. As is obvious from FIG. 6, the notches N of each two adjacent notch rows 19 in the width direction of the notch array are disposed alternately as seen in the row direction of the notch rows 19.

According to the present embodiment, as is clear from FIG. 4, the right and left notch arrays 16*a* and 18*a* that define the width of the box body 8 are arranged symmetrically to a longitudinal axis of the box body 8. In short, the notch rows 19 of the right and left notch arrays are inclined in opposite directions to each other.

The notch arrays 16*a* and 18*a* practically decrease the thickness of the blank 28. In result, the regions of the blank 28, in which the notch arrays 16*a* and 18*a* are located, are more flexible than other region of the blank 28. For this reason, when the round edges 16 and 18 are created by folding the blank 28 along the notch arrays 16*a* and 18*a*, the notch rows 19 of the notch arrays 16*a* and 18*a* absorb difference between an arc length of outer surfaces of the round edges 16 and 18 and an arc length of inner surfaces thereof, thereby forming smooth outer surfaces in the round edges 16 and 18 of the box body 8 and the lid 6.

Even if there are an extremely thin region in the notch arrays 16*a* and 18*a* in terms of the thickness of the blank 28, and the thin region extends in the longitudinal direction of the blank 28, the notch rows 19 do not produce the fragile portion in the notch arrays since the notch rows 19 are inclined in relation to the longitudinal axis of the blank 28.

When the flaps of the blank 28 are folded along the notch arrays 16*a* and 18*a*, the folding work is stably carried out. Consequently, the notch arrays 16*a* and 18*a* surely form the round edges 16 and 18 each having an accurate arc-like shape. As is evident from FIG. 5, the notch arrays 16*a* and 18*a* are not exposed in the outer surface of the blank 28. The round edges 16 and 18 therefore have smooth outer surfaces, and a package with an excellent appearance can be obtained.

Since the notch arrays 16*a* and 18*a* are flexible, it is not necessary to preliminarily fold the notch arrays 16*a* and 18*a*. This enables the folding work of the blank 28 to be carried out using a conventional wrapping machine, and the package shown in FIGS. 1 and 2 can be formed without difficulty.

Preferably, each of the notch arrays 16*a* of the blank 28 has a reinforcing patch 60 as shown in FIG. 4, prior to the folding work of the blank 28. Each of the reinforcing patches 60 is disposed at an end portion of the corresponding notch array 16*a*, which is on the closer side to the open end of the box body 8, so as to stretch across the notch array 16*a*.

Figure 7:
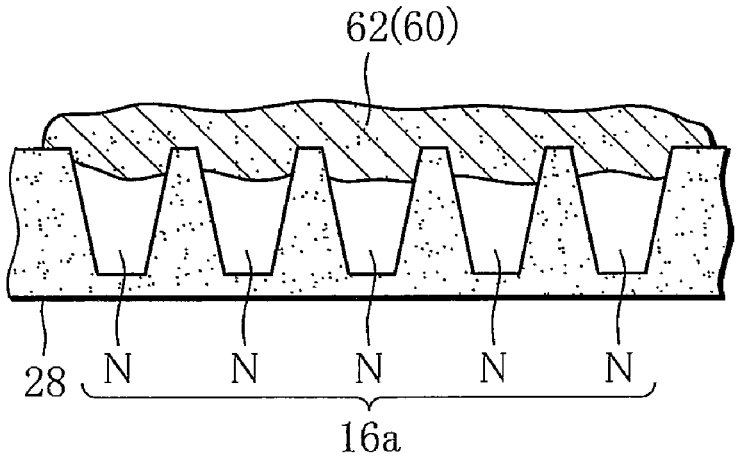
FIG. 7 is a sectional view showing a part of the notch array shown in FIG. 6.
Figure 8:
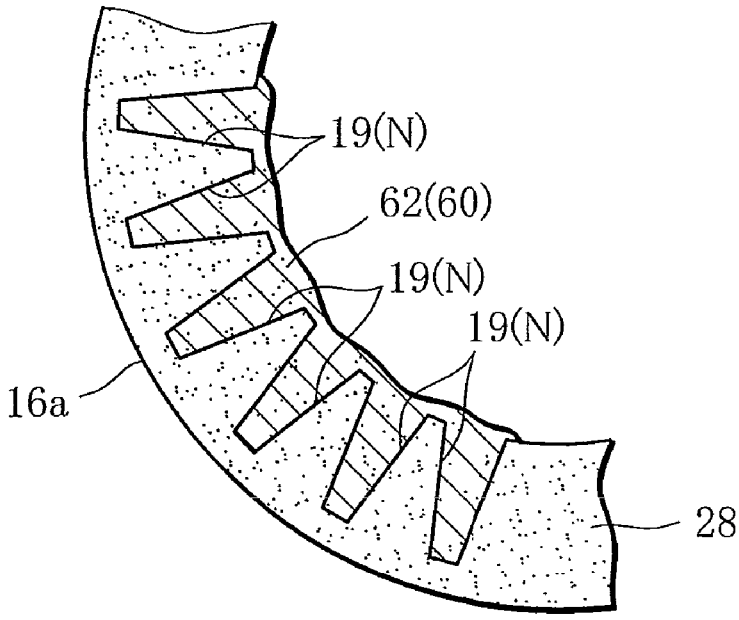
FIG. 8 is a sectional view showing a round edge formed of a notch array by folding the blank along the notch array shown in FIG. 6.

In particular, as is apparent from FIG. 7, the reinforcing patches 60 are made of glue 62 applied to the notch arrays 16*a*. The glue 62 that has just been applied possesses liquidity, so that the reinforcing patches 60, or the glue 62, does not become any resistance against the folding work of the blank 28 in the process of folding the blank 28 along the notch arrays 16*a*. In other words, as shown in FIG. 8, when the blank 28 is folded, the glue 62 gets into notches N. Subsequently, the reinforcing patches 60 obtained after the glue 62 is hardened improve the strength of the notch arrays 16*a*, or the round edges 16, in positions thereof. The open end of the box body 8 then becomes hard to deform, and the lid 6 can be surely and smoothly opened and closed.

The invention is not limited to the one embodiment described above, but may be modified in various ways.

Figure 9:
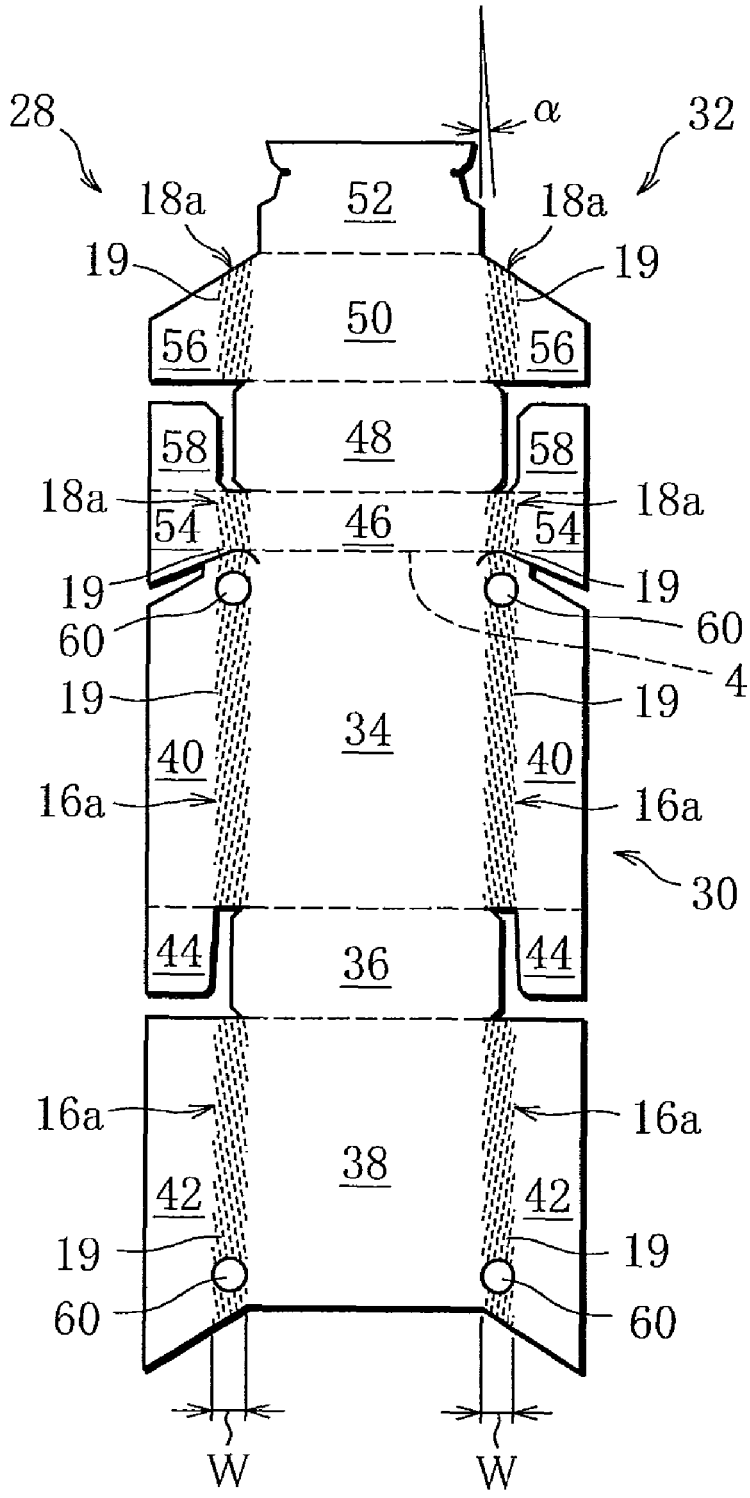
FIG. 9 is a view showing an inner surface of a blank of a modification example.

FIG. 9 shows an inner surface of the blank 28 of a modification example.

The blank 28 shown in FIG. 9 differs from the blank shown in FIG. 4 only in the inclination directions of notch arrays 16*a* and 18*a*. More specifically, in the case of the blank 28 shown in FIG. 9, the notch array 16*a* located on the right side of a rear panel 34 and the notch array 16*a* on the left side are inclined in different directions from each other, similar to the inclination directions of the corresponding notch arrays of the blank shown in FIG. 4.

However, in the case of the blank 28 shown in FIG. 9, as to the notch arrays 16*a* and 18*a* aligned with each other, each two adjacent notch arrays in the longitudinal direction of the blank 28 are inclined in opposite directions to each other.

As to the folding work of the outer and inner side flaps to be superposed upon each other to form the side walls of the box body 8 and the lid 6, free side edges of the side flaps folded are apt to be displaced in the longitudinal direction of the blank 28 in relation to the notch arrays, due to the inclination directions of the notch arrays 16*a* and 18*a*. However, the displacing directions of the free side edges are opposite to each other between the outer side flaps and the inner side flaps.

When the outer and inner side flaps are superposed upon and adhered to each other to form the side walls, the above-mentioned displacement is therefore offset between the outer and inner side flaps. Consequently, the notch arrays 16*a* and 18*a* of the side flaps reliably form the round edges 16 and 18.

Figure 10:
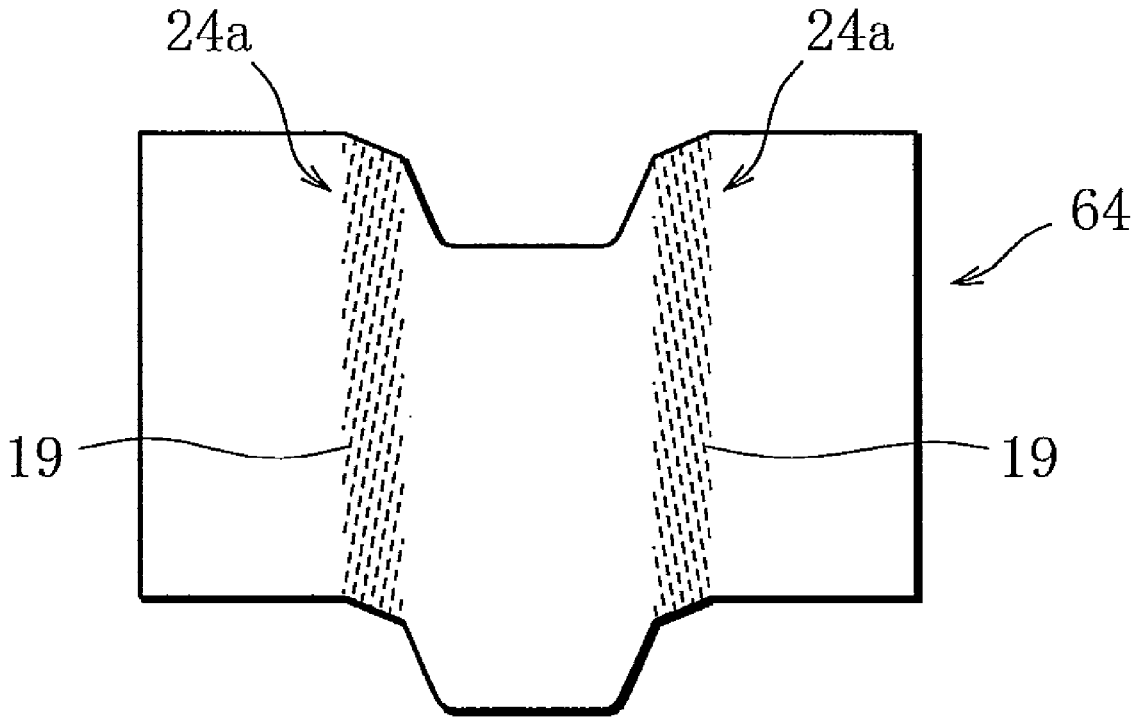
FIG. 10 is a view showing a blank for forming an inner frame of the modification example.

FIG. 10 shows a paper blank 64 for forming an inner frame 10 of the modification example.

The blank 64 has two notch arrays 24*a* similar to the notch arrays 16*a*. The notch arrays 24*a* form round edges similar to the round edges 16 instead of the angular edges 24.

With reference to FIG. 4, the notch rows 19 of the right and left notch arrays 16*a* and 18*a* are inclined so that extended lines of the notch rows 19 intersect with each other above the blank 28. Alternatively, the notch rows 19 may be inclined in such a direction that the extended lines thereof intersect with each other under the blank 28.

The angular edges of the bottom wall of the box body 8 and those of the upper wall of the lid 6 may be replaced with round edges similar to the above-mentioned round edges.

Notches N(19) shown in FIGS. 7 and 8 each have an inverted trapezoid cross-section, but do not necessarily have such a cross-sectional shape.

The package of the invention needs to have at least either one of the round edges 16 or 18. The invention can be applied not only to the hinge-lid package but also to a tongue-lid package as well.

The invention claimed is:

1. A package of rod-shaped smoking articles, comprising:

a box body with an open end, said box body including round edges forming four longitudinal edges of said box body, said round edges extending along a longitudinal direction of said box body and having an arc-like shape as seen in cross-section of said box body, each of said round edges having only in an inner surface of said round edge notch rows for providing the arc-like shape of said round edges, said notch rows being formed of a plurality of notches, respectively, inclined only in the same direction in relation to the longitudinal direction of said box body and arranged at intervals in a width direction of said round edge; and a box-shaped lid connected to the open end of said box body through a hinge, for opening/closing the open end, wherein said notch rows of two round edges defining the width of said box body are inclined in opposite directions relative to each other and the notch rows of two round edges defining the thickness of said box body are inclined in opposite directions relative to each other.

2. The package of rod-shaped smoking articles according to claim 1, wherein said lid has four round edges corresponding to said round edges of said box body.

3. The package of rod-shaped smoking articles according to claim 1, wherein said box body further includes a reinforcing patch disposed in the inner surface of each of said round edges, the reinforcing patches being disposed near the open end.

4. The package of rod-shaped smoking articles according to claim 3, wherein the reinforcing patch is made of glue.

5. A blank for the package claimed in claim 1, comprising a main section extending in one direction and forming said box body, and a subsection connected to one end of said main section through a hinge to form said lid, wherein said main section includes:

a rear panel, a bottom panel, and a front panel aligned in the one direction, the rear, bottom, and front panels, among which each two adjacent panels being connected to each other through a horizontal fold line, for forming a rear wall, a bottom wall, and a front wall, respectively, of said box body; and inner and outer side flaps connected to both sides of the rear panel and of the front panel through longitudinal fold lines, for forming inner and outer parts of side walls of said box body, wherein all of the longitudinal fold lines, only in an inner surface of the blank, being formed of notch rows to provide an arc-like shape of said round edge, the notch rows having a plurality of notches, respectively, inclined only in the same direction and arranged at intervals in a width direction of the notch rows, wherein the notch rows of two longitudinal fold lines defining the width of said box body are inclined in opposite directions relative to each other and the notch rows of two longitudinal fold lines defining the thickness of said box body are inclined in opposite directions relative to each other.

* * * * *

UNITED STATES PATENT AND TRADEMARK OFFICE

CERTIFICATE OF CORRECTION

PATENT NO. : 8,157,087 B2
APPLICATION NO. : 12/609679
DATED : April 17, 2012
INVENTOR(S) : Hitoshi Tanbo It is certified that error appears in the above-identified patent and that said Letters Patent is hereby corrected as shown below:

ON THE TITLE PAGE:

At item (63), change the PCT filing date from "Nov. 13, 2008" to --Apr. 21, 2008--.

IN THE SPECIFICATION:

At column 1, lines 5-6, change the PCT filing date from "Nov. 13, 2008" to --Apr. 21, 2008--.

Signed and Sealed this
Thirty-first Day of July, 2012

David J. Kappos

David J. Kappos
*Director of the United States Patent and Trademark Office*